US008834051B2

(12) United States Patent
Yoon

(10) Patent No.: US 8,834,051 B2
(45) Date of Patent: Sep. 16, 2014

(54) WRITING IMPLEMENT WITH SIMULTANEOUS RETRACTABLE ENDS

(75) Inventor: Hyun-Son Yoon, Incheon (KR)

(73) Assignee: Morris Corporation, Incheon-shi (KR)

( * ) Notice: Subject to any disclaimer, the term of this patent is extended or adjusted under 35 U.S.C. 154(b) by 444 days.

(21) Appl. No.: 13/260,135

(22) PCT Filed: Mar. 23, 2010

(86) PCT No.: PCT/KR2010/001778

§ 371 (c)(1),
(2), (4) Date: Sep. 23, 2011

(87) PCT Pub. No.: WO2010/110583

PCT Pub. Date: Sep. 30, 2010

(65) Prior Publication Data

US 2012/0014737 A1 Jan. 19, 2012

(30) Foreign Application Priority Data

Mar. 24, 2009 (KR) ..... 10-2009-0024724

(51) Int. Cl.
*B43K 7/12* (2006.01)
*B43K 5/16* (2006.01)

(Continued)

(52) U.S. Cl.
CPC . *B43K 8/003* (2013.01); *B43K 8/24* (2013.01); *B43L 19/0068* (2013.01); *B43K 8/028* (2013.01); *B43L 19/0018* (2013.01); *B43K 29/02* (2013.01); *B43K 8/06* (2013.01); *B43L 19/0056* (2013.01); *B43K 24/06* (2013.01)
USPC ..... 401/108; 401/99; 401/107

(58) Field of Classification Search
CPC ..... B43K 7/12; B43K 21/006; B43K 24/06; B43K 29/02; B43K 8/24; B43K 8/028
USPC ..... 401/99, 107–109, 112, 113, 116
See application file for complete search history.

(56) References Cited

U.S. PATENT DOCUMENTS 3,146,758 A * 9/1964 Zepell ..... 401/106
4,352,581 A 10/1982 Leuthold et al.

(Continued)

FOREIGN PATENT DOCUMENTS

JP 03-045187 U 4/1991
KR 20-1999-0021301 3/2000
KR 10-2005-0105758 A 11/2005
KR 10-2007-0112889 A 11/2007

OTHER PUBLICATIONS

International Search Report for PCT Application No. PCT/KR2010/001778. Korean Intellectual Property Office. Nov. 4, 2010.

*Primary Examiner* — David Walczak
*Assistant Examiner* — Jennifer C Chiang
(74) *Attorney, Agent, or Firm* — Intellectual Property Law Group LLP

(57) ABSTRACT

A writing implement, with retractable ends, an upper shaft and lower shaft coupled together and rotatable relative to each other, a cartridge and an eraser holder in an intermediate connection member are simultaneously movable in upward and downward directions. The cartridge having a writing nib; the connection member having a slit; the lower shaft coupled to the connection member, a nib hole for extending/retracting the nib therethrough; the upper shaft having a thread enabling the cartridge to move with the integrated rotation of the connection member and lower shaft; a cam coupled to the upper shaft, having an inner wall with a protrusion; an eraser holder engages the protrusion and slit and rotates in upward and downward directions with the rotation of the connection member and lower shaft; and a ball shutter in the lower shaft to open/shut the nib hole by means of the vertical sliding of the cartridge.

9 Claims, 11 Drawing Sheets

(51) Int. Cl.

| | |
|---|---|
| ***B43K 8/24*** | (2006.01) |
| ***B43L 19/00*** | (2006.01) |
| ***B43K 8/02*** | (2006.01) |
| ***B43K 8/00*** | (2006.01) |
| ***B43K 29/02*** | (2006.01) |
| ***B43K 8/06*** | (2006.01) |
| ***B43K 24/06*** | (2006.01) |

(56) References Cited

U.S. PATENT DOCUMENTS

| | | | | |
|---|---|---|---|---|
| 5,015,111 | A * | 5/1991 | Petterson | 401/52 |
| 5,356,232 | A * | 10/1994 | Skinner | 401/52 |
| 7,284,927 | B2 * | 10/2007 | Kageyama | 401/93 |
| 7,329,063 | B2 * | 2/2008 | Kato | 401/116 |

* cited by examiner

WRITING IMPLEMENT WITH SIMULTANEOUS RETRACTABLE ENDS

PRIORITY

The present application claims priority under 35 U.S.C. §371 to PCT Application PCT/KR2010/001778, filed on Mar. 23, 2010, which claims priority to Korean Patent Application No. 10-2009-0024724, filed on Mar. 24, 2009, the disclosures of which are hereby incorporated by reference in their entireties.

TECHNICAL FIELD

The present invention relates generally to a writing implement with simultaneous retractable ends and, more particularly, to a writing implement with simultaneous retractable ends, which is applied to a whiteboard pen (also referred to as a marker pen) which is used to write letters on a whiteboard, thus enabling a nib and an eraser provided on opposite ends of the writing implement to be simultaneously ejected or retracted.

BACKGROUND ART

Conventionally, letters written on a whiteboard with a marker pen are removed using an eraser for a whiteboard. Since the marker pen and the eraser are separated from each other, a user must find the eraser to remove the letters written with the marker pen, thus inconveniencing the user. Further, the letters cannot be rapidly removed, and the eraser may frequently be lost.

In order to overcome such an inconvenience, Korean Utility Model Application No. 20-1999-0021301 was disclosed, which is entitled 'whiteboard pen equipped with eraser' and is configured so that a marker pen and an eraser are integrated with each other.

As shown in FIG. 1, the conventional whiteboard pen is configured so that the long and thin eraser corresponding to the length of the whiteboard pen is integrally attached to the pen in such a way as to be detachable from the pen, thus enabling use of the pen and the eraser to be very convenient.

However, the conventional whiteboard pen is problematic in that the eraser is attached to an exterior of the pen, so that residual ink remains on the eraser after it removes letters, and a user's hand may be stained with the ink when the pen is in use, thus inconveniencing the user.

Moreover, all of letters written with the marker pen cannot be removed. However, it is difficult to precisely remove only a desired portion of the letters because of its limited shape. Further, when the letters are partially removed, the sensation when gripping is poor, thus making it inconvenient to partially remove the letters.

Further, the eraser protrudes from the marker pen, so that it is not easy to store the pen. The eraser covered with the ink is exposed, thus negatively affecting the appearance of the marker pen.

DISCLOSURE

Technical Problem

Accordingly, the present invention has been made keeping in mind the above problems occurring in the prior art, and an object of the present invention is to provide a writing implement with simultaneous retractable ends, which has an eraser holder on an upper end of a marker pen in such a way as to be retractably ejected from a main body.

Another object of the present invention is to provide a writing implement with simultaneous retractable ends, which is configured so that an eraser holder provided on an upper end of the writing implement is ejected simultaneously when a nib provided on a lower end thereof is ejected, and is retracted simultaneously when the nib is retracted.

Technical Solution

In order to accomplish the above objects, the present invention provides a writing implement with simultaneous retractable ends including a cartridge having a writing nib; an intermediate connection member having a slit to move the cartridge up and down while accommodating the cartridge therein; a lower shaft fixedly coupled with the intermediate connection member and having a nib hole through which the nib is ejected or retracted; an upper shaft having a thread to move the cartridge accommodated in the intermediate connection member, as the intermediate connection member and the lower shaft rotate integrally; a cam fixedly coupled to an end of the upper shaft, with a protrusion formed on an inner wall of the cam; an eraser holder accommodated in the intermediate connection member to rotate up and down while engaging with an inner protrusion of the cam and a slit of the intermediate connection member, as the intermediate connection member and the lower shaft rotate integrally; and a ball shutter accommodated in the lower shaft so that vertical movement of the cartridge will open and close the nib hole.

Further, according to the present invention, the cartridge may preferably include a ball-shutter locking step formed on a junction between a nib extension shaft and an ink supply part, thus preventing the nib of the cartridge passing through an interior of the ball shutter from moving forwards any more from the ball shutter; a first spring locking step protruding from a predetermined position on an outer surface of the ink supply part so that a first spring generates an elastic force between the cartridge and an upper end of the ball shutter; a thread movement protrusion protruding from an end of the ink supply part, and moving along the thread of the upper shaft while simultaneously moving linearly along the slit of the intermediate connection member; and a ball-shutter movement protrusion protruding from the ball-shutter locking step in such a way as to move linearly within a slit of the ball shutter.

Further, according to the present invention, a holder of the ball shutter may preferably have a cartridge movement slit in a direction of the cartridge, so that the ball-shutter movement protrusion of the cartridge moves within the cartridge movement slit.

Further, according to the present invention, the intermediate connection member may preferably include a lower-shaft coupling ring provided on a lower end thereof in a shape of a convex ring so that a lower portion thereof fixedly engages with a corresponding inner groove of the lower shaft; an annular upper-shaft coupling groove formed at a position spaced apart from the lower-shaft coupling ring by a predetermined distance, thus allowing the intermediate connection member and the upper shaft to be rotatably coupled with each other; an anti-rotation protrusion protruding at a position spaced apart from the upper-shaft coupling groove by a predetermined distance; and an anti-slip step formed on an upper end of a slit extending from the anti-rotation protrusion to an upper end of the intermediate connection member, wherein a thread movement protrusion of the cartridge accommodated in the intermediate connection member may protrude out of the slit, so that the thread movement protrusion may move within the slit by rotation of the intermediate connection member and the lower shaft, and the eraser holder may move in a space of the slit located at the upper end of the intermediate connection member, so that the eraser holder moving towards the upper end along the slit may stop moving towards the nib because of the anti-slip step.

Preferably, according to the present invention, the intermediate connection member may further include a lower-shaft coupling slit on the lower-shaft coupling ring to be perpendicular to the lower-shaft coupling ring so that the intermediate connection member is firmly coupled with the lower shaft, the lower-shaft coupling slit engaging with a step formed at a corresponding position on the lower shaft when the intermediate connection member is coupled with the lower shaft.

Further, according to the present invention, the lower shaft may preferably include a groove formed at a position corresponding to a lower-shaft coupling ring of the intermediate connection member to engage with the lower-shaft coupling ring, thus allowing the lower shaft to be fixedly coupled with the intermediate connection member; a ring support step formed on an inner wall of a predetermined portion of the lower shaft to allow an upper ring of the ball shutter to be fixedly attached; and a second spring locking step formed at a position spaced apart from the ring support step by a predetermined distance so that the second spring locking step and a step formed on an outer surface of the ball shutter come into contact with opposite ends of the second spring.

Further, according to the present invention, the upper shaft may preferably include an intermediate-connection-member coupling ring formed on a lower portion of an inner surface thereof to be rotatably coupled with an upper-shaft coupling groove of the inserted intermediate connection member; a stopper formed at a position spaced apart from the intermediate-connection-member coupling ring by a predetermined distance, and having a predetermined protruding thickness to allow an anti-rotation protrusion of the intermediate connection member to pass over the stopper; a locking step provided at a position around the stopper, and having a predetermined protruding thickness to prevent the anti-rotation protrusion of the intermediate connection member from passing over the locking step; an upper-shaft thread formed at a position spaced apart from the stopper or the locking step by a predetermined distance to form a guide line along which a thread movement protrusion of the cartridge moves while the cartridge rotates together with the intermediate connection member; a cam coupling groove formed in an upper portion of the upper shaft in a ring shape to engage with a coupling ring of the cam; and a cam support step formed on the cam coupling groove in such a way as to be perpendicular thereto, thus allowing the cam to be fixedly coupled to the upper shaft.

Further, according to the present invention, the cam may preferably include a threaded protrusion formed in the cam to move upwards along a thread of the eraser holder; an upper-shaft coupling ring protruding from a lower portion on an outer surface of the cam in a ring shape to be fixedly coupled with the upper shaft; and an anti-rotation slit formed on the upper-shaft coupling ring in such a way as to be perpendicular thereto, thus preventing the cam from rotating.

Further, according to the present invention, the eraser holder may preferably include a slit movement protrusion formed on an outer surface of a lower end of the eraser holder to move linearly while protruding out of a slit of the intermediate connection member; a thread formed on an outer surface of the eraser holder from the slit movement protrusion to an upper end of the eraser holder, thus allowing a threaded protrusion of the cam to move up and down along the thread; and an eraser receiving portion formed in an upper end of the eraser holder to receive an eraser therein.

Advantageous Effects

As apparent from the above description, a writing implement with simultaneous retractable ends of the present invention is advantageous in that an eraser holder is provided on an upper end of a marker pen, so that even if residual ink remains on an eraser, the ink is stored in a main body after the eraser has been used, thus preventing a user from being stained with ink.

Further, a writing implement with simultaneous retractable ends of the present invention is advantageous in that, when a nib of the writing implement is ejected, an eraser holder is also ejected simultaneously, and when the nib is retracted, the eraser holder is also retracted simultaneously, so that it is unnecessary to take or put an eraser out of or into the writing implement.

Figure 1:
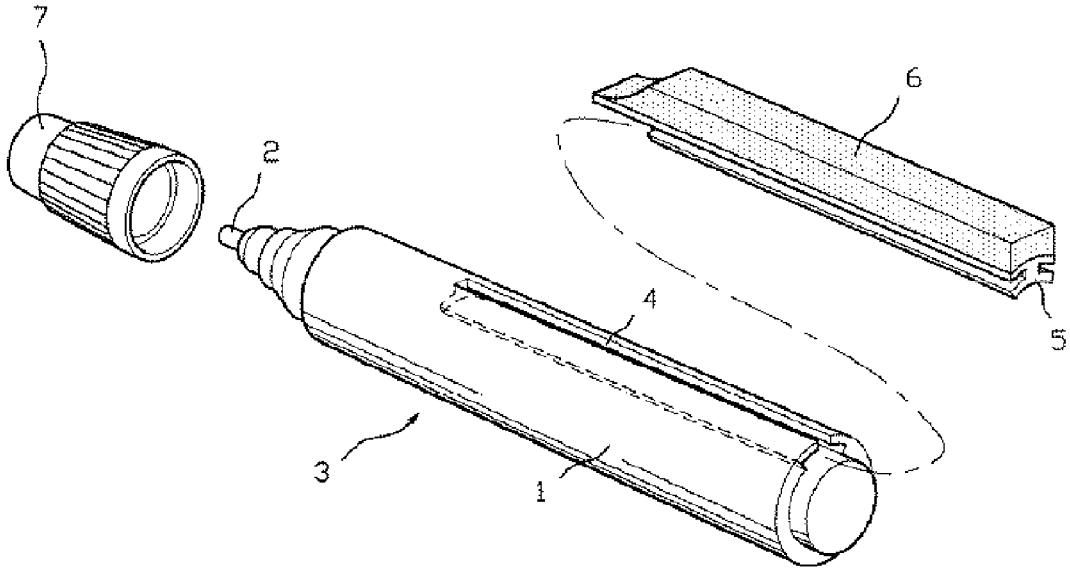
FIG. 1 is an exploded perspective view illustrating a conventional marker pen.

*Description of reference characters of important parts*

| | |
|---|---|
| 100: upper shaft | 200: lower shaft |
| 300: eraser holder | 400: cam |
| 500: cartridge | 600: ball shutter |
| 700: intermediate connection member | |

BEST MODE

Hereinafter, a writing implement with simultaneous retractable ends according to an embodiment of the present invention will be described in detail with reference to the accompanying drawings.

Figure 2:
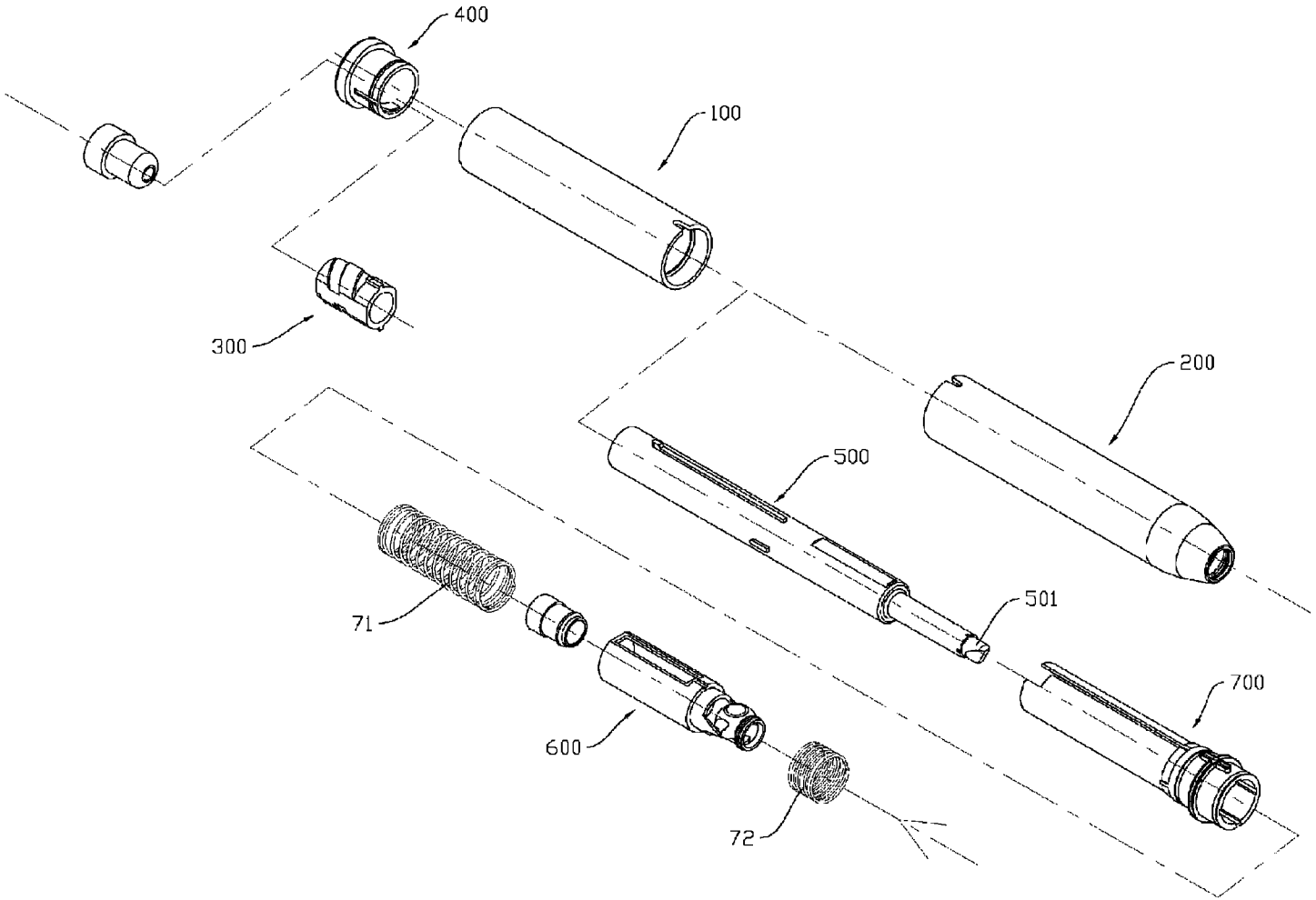
FIG. 2 is an exploded perspective view illustrating a writing implement with simultaneous retractable ends according to an embodiment of the present invention.

FIG. 2 is an exploded perspective view illustrating a writing implement with simultaneous retractable ends according to an embodiment of the present invention.

As shown in FIG. 2, the writing implement with simultaneous retractable ends of the present invention includes a cartridge 500, an intermediate connection member 700, a lower shaft 200, an upper shaft 100, a cam 400, an eraser holder 300, and a ball shutter 600. The cartridge 500 is provided with a writing nib 501. The intermediate connection member 700 has a slit to permit vertical movement of the cartridge therein. The lower shaft 200 is fixedly coupled to the intermediate connection member. The upper shaft 100 has a thread to move a cartridge protrusion accommodated in the intermediate connection member, as the intermediate connection member integrally rotates along with the lower shaft. The cam 400 is fixedly coupled to an end of the upper shaft 100. The eraser holder 300 rotates up and down while engaging with a protrusion in the cam and the slit of the intermediate connection member. The vertical movement of the cartridge causes the ball shutter 600 to open or close a nib hole.

In addition to the above components, a first spring 71 and a second spring 72 are coupled with the cartridge in the upper shaft to elastically move the cartridge and open or close the ball shutter.

Here, an elastic force of the first spring 71 is greater than that of the second spring 72. Thus, even if the cartridge applies the same pressure to the first and second springs, the second spring 72 is first compressed after which the first spring 71 is compressed.

Further, according to the present invention, in order to more firmly couple the components to each other and to more efficiently disperse force when the writing implement is in operation, a pair of protrusions, steps, grooves or threads are preferably formed on opposite sides of an outer surface or an inner surface of each component.

In the embodiment of the present invention that will be described below, a direction of the nib hole in which the nib is ejected is designated as a lower position, while a direction of the cam in which the nib is retracted is designated as an upper position. Further, in the case of the operation of the writing implement, a direction towards the nib hole is designated as a forward or upward direction, and a direction towards the cam is designated as a backward or downward direction.

Figure 3:
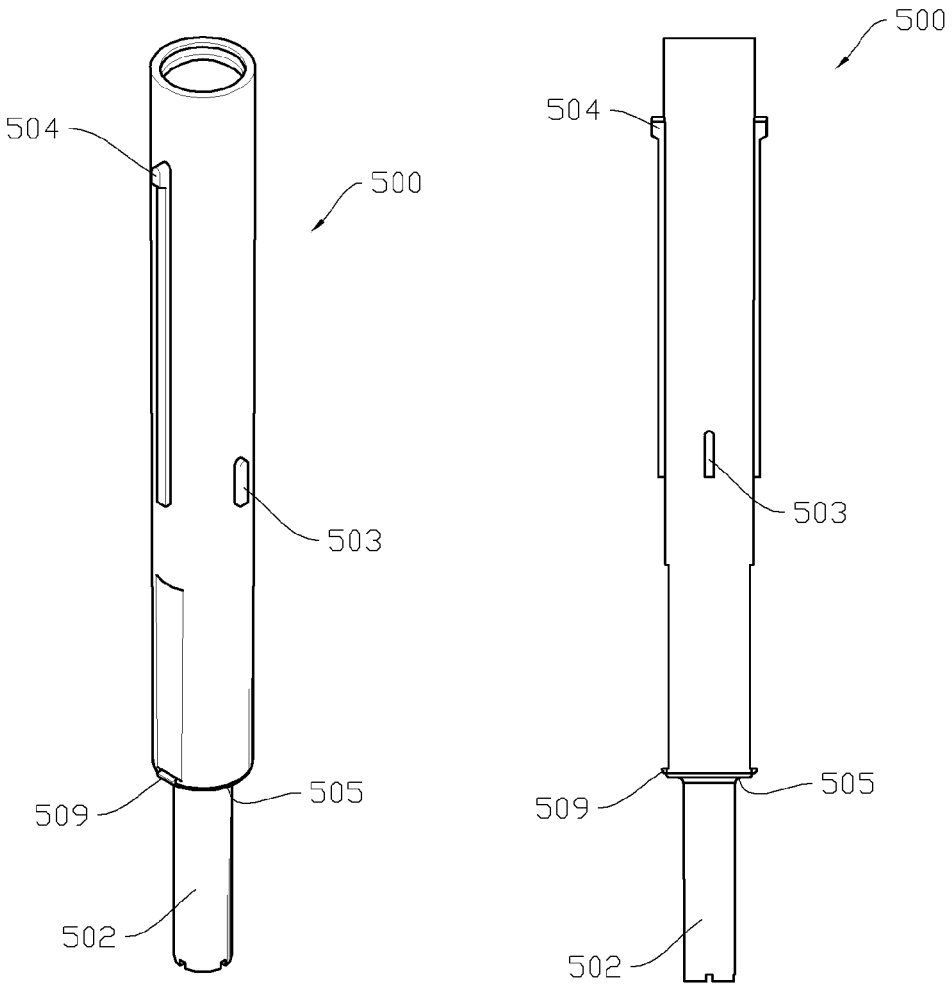
FIG. 3 is a view illustrating a cartridge according to the embodiment of the present invention in a perspective view and a side view.

FIG. 3 is a view illustrating a cartridge 500 according to the embodiment of the present invention in a perspective view and a side view.

As shown in FIG. 3, the nib 501 is provided on a lower portion of the cartridge. Such a nib 501 is coupled to be supplied with ink through a coupling hole formed in an end of a nib extension shaft 502.

The nib extension shaft 502 is shaped like a hollow cylindrical tube to supply the ink, and has a diameter that is relatively smaller than that of the tank.

Further, the nib 501 may be secured to an end of the nib extension shaft 502 so that ink or contents stored in the tank are supplied to the nib by a general ink supply method (e.g. capillary phenomenon, pressure difference, suction, etc.) corresponding to the kind of writing implement it is associated with.

The nib 501 may use a tip for oil- or water-based ink, a tip for discharging a correction fluid, a tip for a highlighter, or a tip for a marker pen according to the kind of a writing implement. Of course, ink supply methods corresponding to the respective tips may be applied.

The cartridge 500 is operated by a retractable mechanism, which will be described below, such that the nib 501 is ejected from or retracted into the nib hole 205 of the lower shaft 200.

The cartridge 500 has a ball-shutter locking step 505 on a junction between the nib extension shaft 502 and an ink supply part, thus preventing the nib 501 of the cartridge 500 that passes through an interior of the ball shutter 600 from moving forwards any more from the ball shutter 600.

The cartridge 500 has a first spring locking step 503 protruding from a predetermined portion on an outer surface of the ink supply part, thus allowing the first spring 71 to generate an elastic force between the first spring locking step 503 of the cartridge 500 and an upper end of the ball shutter 600.

A thread movement protrusion 504 is formed on an end of the ink supply part of the cartridge 500.

The thread movement protrusion 504 moves along a thread formed in the inner surface of the upper shaft 100 in intaglio, and moves linearly along the slit of the intermediate connection member 700 that will be described below in detail.

Further, the cartridge 500 has a ball-shutter movement protrusion 509 formed on the ball-shutter locking step 505, so that the cartridge moves linearly within a slit of the ball shutter 600 that will be described below.

Figure 4:
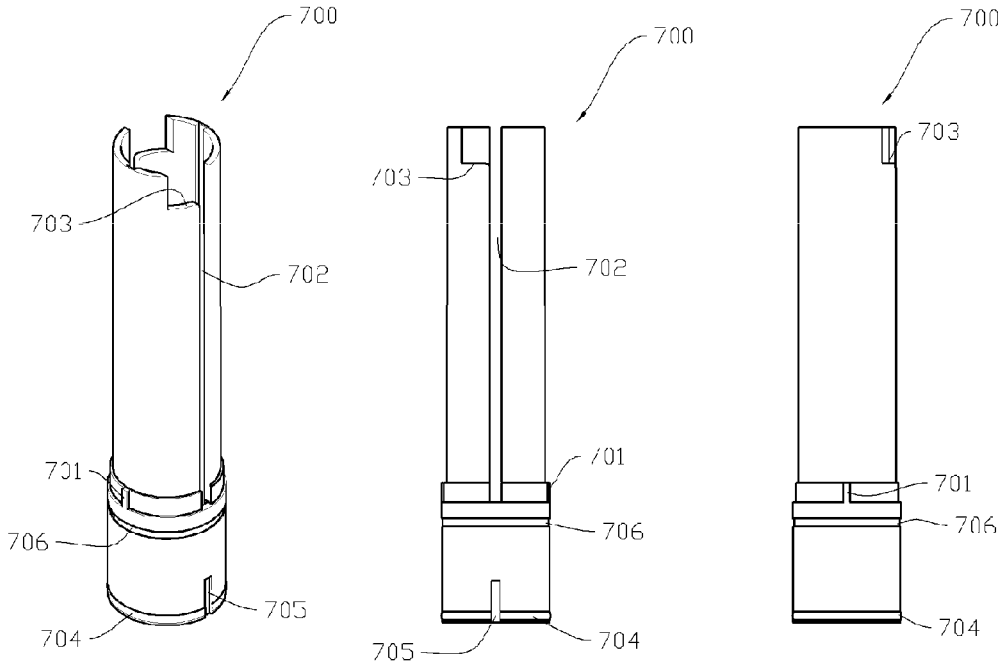
FIG. 4 is a view illustrating an intermediate connection member according to the embodiment of the present invention in a perspective view and a side view.

FIG. 4 is a view showing an intermediate connection member 700 according to the embodiment of the present invention in a perspective view and a side view, in which a slit is formed in the intermediate connection member to move the cartridge 500 up and down in the intermediate connection member.

As shown in FIG. 4, the intermediate connection member 700 is hollow therein to allow the cartridge 500 and the eraser holder 300 accommodated in the intermediate connection member to move inwards and outwards from opposite sides thereof.

Further, the intermediate connection member 700 has on a lower end thereof a convex lower-shaft coupling ring 704 so that the lower end is fixedly coupled to the lower shaft 200 which will be described below in detail. Thereby, the lower-shaft coupling ring engages with a corresponding inner groove of the lower shaft 200.

Preferably, in order to firmly couple the intermediate connection member 700 with the lower shaft 200, a lower-shaft coupling slit 705 is formed on the lower-shaft coupling ring 704 in such a way as to be perpendicular to the lower-shaft coupling ring 704. Thereby, when the intermediate connection member is coupled with the lower shaft 200, the lower-shaft coupling slit engages with a step (formed at a corresponding position in the lower shaft 200), thus preventing the intermediate connection member 700 and the lower shaft 200 from rotating relative to each other.

The intermediate connection member 700 has an annular upper-shaft coupling groove 706 at a position spaced apart from the lower-shaft coupling ring 704 by a predetermined distance, so that the intermediate connection member is rotatably coupled with the upper shaft 100.

Further, an anti-rotation protrusion 701 protrudes from a position spaced apart from the upper-shaft coupling groove 706 by a predetermined distance, so that the anti-rotation protrusion 701 is caught between a locking step and a stopper of the upper shaft 100 during the rotation of the upper shaft 100 that will be described below in detail, thus preventing the intermediate connection member from rotating any more.

A slit 702 extends from the anti-rotation protrusion 701 to the upper end of the intermediate connection member 700, with an anti-slip step 703 being formed on a portion of the slit 702 located at the upper end of the intermediate connection member 700.

That is, the thread movement protrusion 504 of the cartridge 500 accommodated in the intermediate connection member 700 protrudes out of the slit 702, so that the thread movement protrusion 504 moves in the slit 702 by the rotation of the intermediate connection member 700 and the lower shaft 200.

A slit movement protrusion of the eraser holder 300 is movable in a portion of the slit 702 located at the upper end of the intermediate connection member 700. The slit movement protrusion accommodated in the upper end of the intermediate connection member 700 in such a way as to protrude out of the slit moves along the slit 702 towards the upper end. Here, the movement of the slit movement protrusion towards the nib is stopped by the anti-slip step 703.

Figure 5:
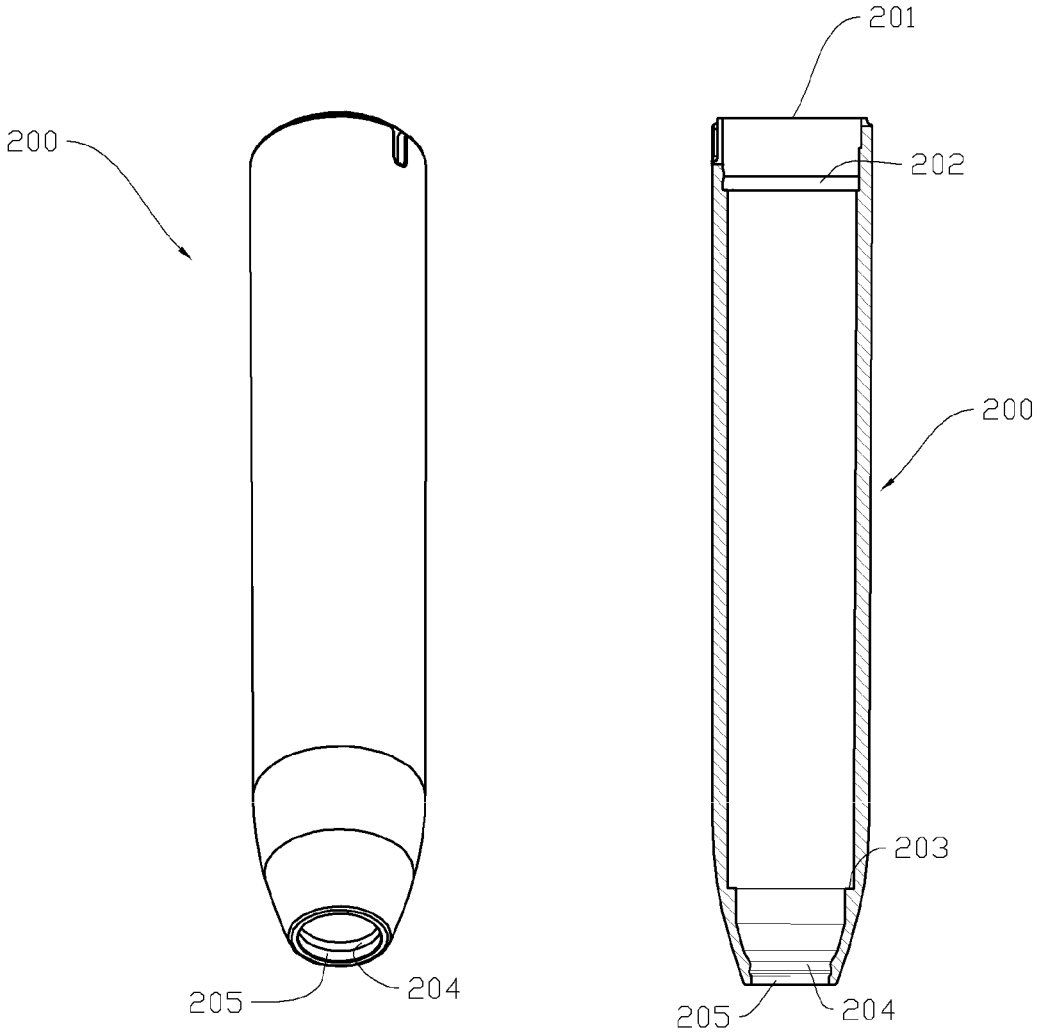
FIG. 5 is a view illustrating a lower shaft according to the embodiment of the present invention in a perspective view and a sectional view.

FIG. 5 is a view illustrating a lower shaft 200 according to the embodiment of the present invention in a perspective view and a sectional view, wherein the lower shaft receives the cartridge 500 and the nib is retractably ejected from the lower shaft.

As shown in FIG. 5, in order to firmly couple the lower shaft 200 to the intermediate connection member 700, a groove 202 and a step (reference numeral is not designated) are formed at corresponding positions on the lower-shaft coupling ring 704 and the lower-shaft coupling slit 705 of the intermediate connection member 700 so that they are engaged with each other.

Further, the circular nib hole 205 is formed in an end of the lower shaft 200 to eject or retract the nib 501 therethrough. A ring support step 204 is formed in the nib hole 205 to allow an upper ring of the ball shutter 600 to be fixedly attached thereto.

Further, the lower shaft 200 has a second spring locking step 203 at a position spaced apart from the ring support step 204 by a predetermined distance, so that the second spring 72 is held between a step formed on the outer surface of the ball shutter 600 that will be described below in detail and the second spring locking step 203.

Figure 6:
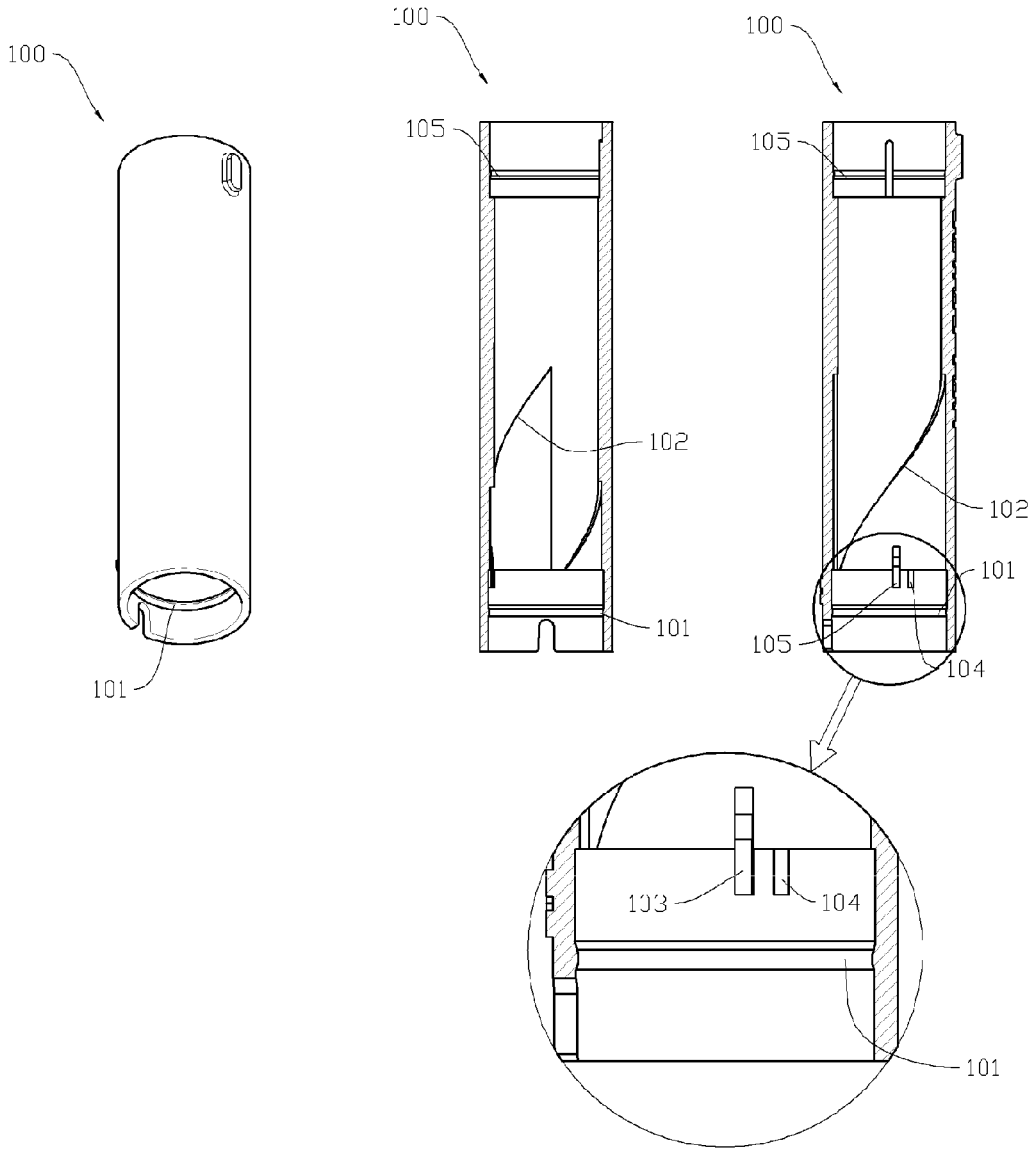
FIG. 6 is a view illustrating an upper shaft according to the embodiment of the present invention in a perspective view and a sectional view.

FIG. 6 is a view illustrating an upper shaft 100 according to the embodiment of the present invention in a perspective view and a sectional view.

As shown in FIG. 6, an intermediate-connection-member coupling ring 101 is formed at a position on an inner surface of the upper shaft 100 in a circular shape, so that the intermediate-connection-member coupling ring rotatably engages with the upper-shaft coupling groove 706 of the intermediate connection member 700 when the above-mentioned intermediate connection member 700 is inserted into the upper shaft.

Further, the upper shaft 100 has a protrusion-type stopper 103 and a locking step 104 at a position spaced apart from the intermediate-connection-member coupling ring 101 by a predetermined distance, thus engaging with the anti-rotation protrusion 701 of the intermediate connection member 700.

That is, as the intermediate connection member 700 rotates relative to the upper shaft 100, the anti-rotation protrusion 701 comes into contact with the stopper 103. Thereafter, as the intermediate connection member 700 further rotates, the anti-rotation protrusion 701 is stopped by the stopper 103, thus preventing the intermediate connection member 700 from rotating in an opposite direction.

Further, the anti-rotation protrusion 701 passing over the stopper 103 is caught by the locking step 104, so that the intermediate connection member 700 does not rotate any more. The stopper 103 firmly holds the intermediate connection member 700 to prevent it from rotating in the opposite direction.

To this end, a protruding extent of the locking step 104 is preferably greater than that of the stopper 103.

Further, an upper-shaft thread 102 is formed at a position spaced apart from the stopper 103 and the locking step 104 by a predetermined distance.

The upper-shaft thread 102 is a guide line along which the thread movement protrusion 504 of the cartridge 500 moves while the cartridge 500 rotates together with the intermediate connection member 700.

According to a thread angle of the upper-shaft thread 102, a moving range of the cartridge 500 moving along the slit 702 of the intermediate connection member 700 is set to be within the range of rotation (rotation by about 180 degrees) of the intermediate connection member 700 and the lower shaft 200. Thus, the upper-shaft thread 102 preferably has a predetermined inclination to allow the nib 501 of the cartridge 500 to protrude sufficiently from the nib hole 205.

A cam coupling groove 105 is annularly formed on an inner surface of an upper portion of the upper shaft 100 to engage with an upper-shaft coupling ring of the cam 400 that will be described below in detail.

Further, the upper shaft 100 has a cam support step 106 that is formed on the cam coupling groove 105 to be perpendicular thereto, and engages with an anti-rotation slit of the cam 400 that will be described below in detail so that the cam 400 is firmly coupled to the upper shaft 100.

Figure 7:
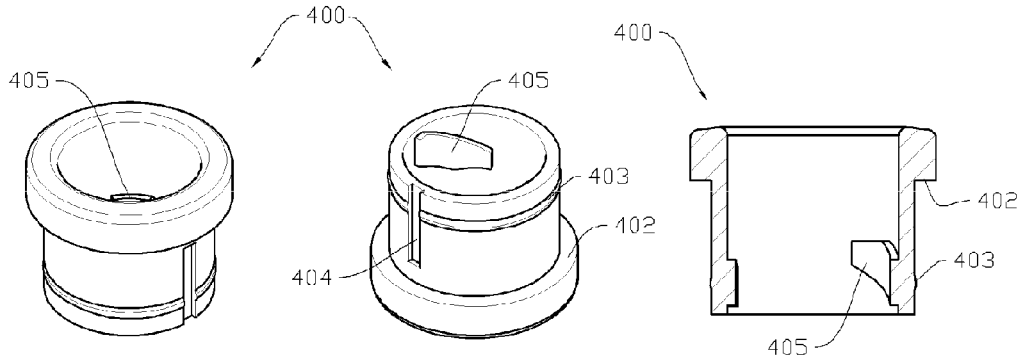
FIG. 7 is a view illustrating a cam according to the embodiment of the present invention in a perspective view and a sectional view.

FIG. 7 is a view illustrating a cam 400 according to the embodiment of the present invention in a perspective view and a sectional view.

As shown in FIG. 7, the cam 400 is hollow therein, with a threaded protrusion 405 formed in the cam.

The threaded protrusion 405 has an inclined surface coming into contact with the thread to move up along the thread of the eraser holder 300 that will be described below in detail.

The upper-shaft coupling ring 403 protrudes from a lower portion on an outer surface of the cam 400. The anti-rotation slit 404 is formed on the upper-shaft coupling ring 403 to be perpendicular thereto.

The cam is firmly coupled with the upper shaft 100 by the anti-rotation slit 404 and the upper-shaft coupling ring 403. Simultaneously, an end of the upper shaft 100 is brought into contact with an upper-shaft locking step 402 that is provided on the upper end of the cam.

Figure 8:
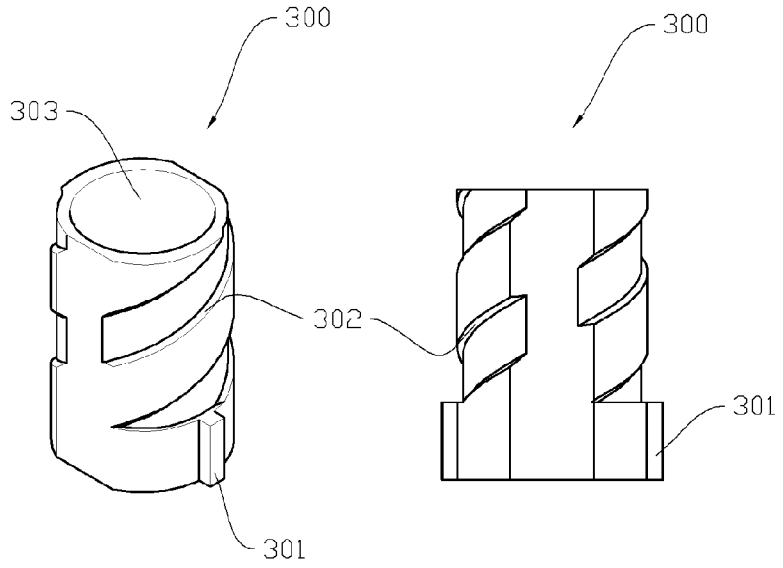
FIG. 8 is a view illustrating an eraser holder according to the embodiment of the present invention in a perspective view and a side view.

FIG. 8 is a view illustrating an eraser holder 300 according to the embodiment of the present invention in a perspective view and a side view.

As shown in FIG. 8, the eraser holder 300 also has a hollow cylindrical shape, and is accommodated in the cam 400 and the upper shaft 100 to rotate therebetween.

A slit movement protrusion 301 is formed on an outer surface of a lower end of the eraser holder 300, so that the eraser holder moves linearly while protruding out of the slit 702 of the intermediate connection member 700.

Further, the slit movement protrusion 301 is caught by the anti-slip step 703 by the rotation of the intermediate connection member 700, thus preventing the eraser holder 300 from moving linearly on the slit.

The thread 302 is formed on an outer surface of the eraser holder 300 in such a way to extend from the slit movement protrusion 301 to the upper end, thus allowing the threaded protrusion 405 of the cam 400 to move up and down along the thread 302.

Preferably, an eraser receiving portion 303 is formed in the upper end of the eraser holder 300 to receive the eraser, and a step (not shown) is formed to prevent an eraser from being removed from the hollow eraser holder 300 through a lower portion thereof.

Figure 9:
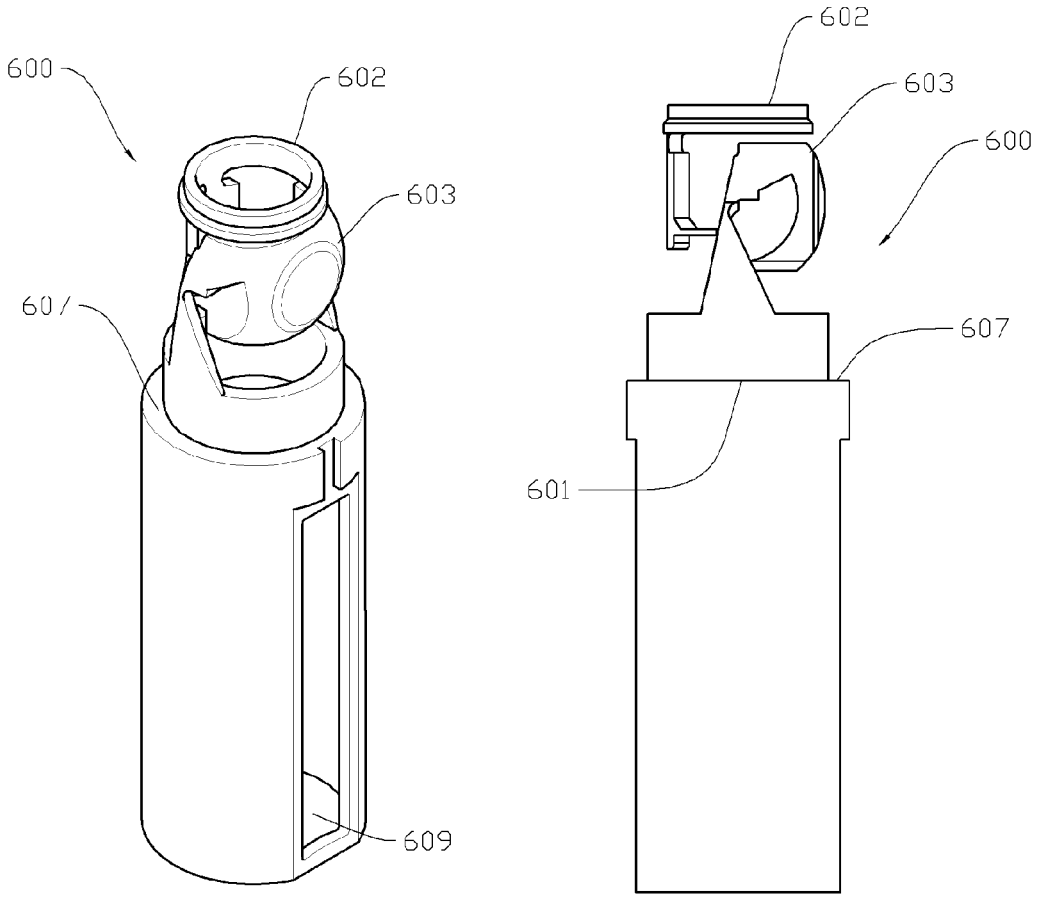
FIG. 9 is a view illustrating a ball shutter according to the embodiment of the present invention in a perspective view and a side view.

FIG. 9 is a view illustrating a ball shutter 600 according to the embodiment of the present invention in a perspective view and a sectional view.

As shown in FIG. 9, since the ball shutter 600 has a structure and an operation similar to those of opening modules of Korean Patent Laid-Open Publication No. 10-2008-0074269 and Korean Patent Publication No. 10-0738904, which were filed by the same applicant as the present invention and are entitled 'retractable writing implements with anti-drying device', a detailed description thereof will be omitted.

The ball shutter 600 is a rubber type packing integrally including an O-ring 602, a spherical door 603 and a holder 604. The spherical door 603 serves as a driven part of the holder 604, thus opening or closing a passage of the holder 604.

The O-ring 602 is firmly attached to the ring support step 204 of the lower shaft 200 so as to prevent the detachment of the O-ring.

The cartridge 500 inserted into the holder 604 of the ball shutter 600 is brought into contact with a cartridge locking step 601 of the ball shutter 600, thus preventing further forward movement of the cartridge 500 towards the nib hole 205.

An end of the holder 604 and the first spring locking step 503 of the cartridge 500 are formed to be in contact with opposite ends of the first spring 71.

Further, a step 607 is formed on an end of the holder 604 in such a way as to be in contact with the second spring 72.

The holder 604 has a cartridge movement slit 609 formed towards the cartridge 500, thus allowing the ball-shutter movement protrusion 509 of the cartridge 500 to move within the cartridge movement slit 609.

If the holder 604 is pulled in the state in which the O-ring 602 is firmly attached to the ring support step 204 of the lower shaft 200, the spherical door 603 rotates at 90 degrees, thus closing an entrance of the holder 604. Thereafter, if the holder 604 returns to its original state, the spherical door 603 rotates again at −90 degrees, thus opening the holder 604. Since the above mechanism was described in detail in the previously filed specification, a detailed description of the mechanism will be omitted. Only the opening state of the ball shutter 600 and the state of the spring will be described when the cartridge 500 moves.

Figure 10:
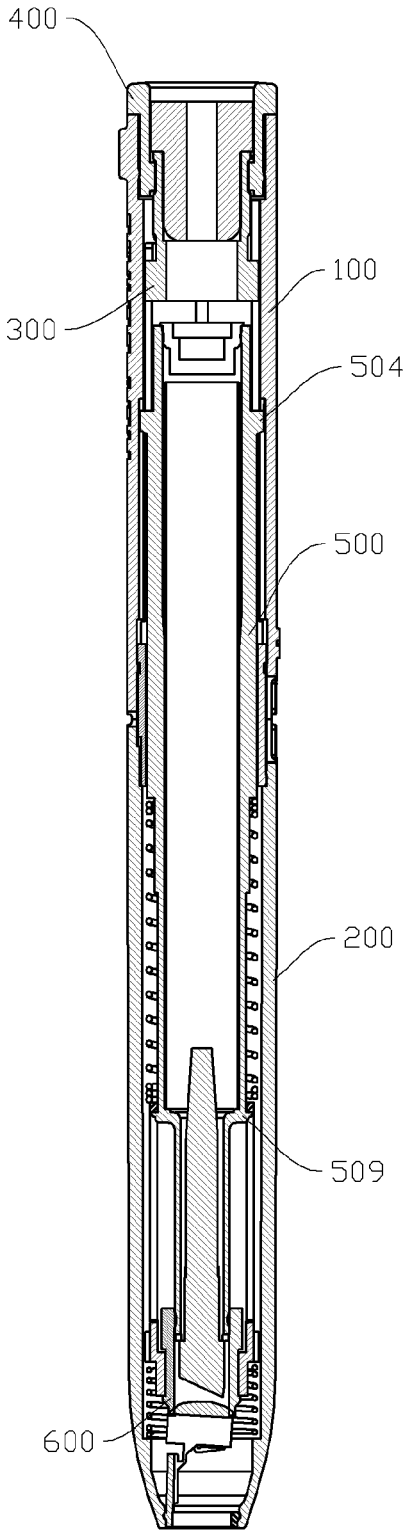
FIG. 10 is a view illustrating a state in which the writing implement with simultaneous retractable ends according to the embodiment of the present invention is retracted.

FIG. 10 is a view illustrating an assembled state of the writing implement with simultaneous retractable ends according to the embodiment of the present invention (the nib is retracted and air-tightly accommodated in the holder).

As shown in FIG. 10, the cartridge 500 is configured such that a lower portion thereof is accommodated in the intermediate connection member 700 and the thread movement protrusion 504 protrudes out of the slit 702.

In order to allow the thread movement protrusion 504 to be seated on the slit 702 when the cartridge 500 is inserted into the intermediate connection member 700, a guide line groove is preferably formed from the lower end of the intermediate connection member 700 to the slit 702.

At this time, the thread movement protrusion 504 of the cartridge 500 is aligned with the anti-slip step 703 of the slit 702 of the intermediate connection member 700.

Further, the intermediate connection member 700 is accommodated in the upper shaft 100, the upper-shaft coupling groove 706 engages with the intermediate-connection-member coupling ring 101, and the thread movement protrusion 504 of the cartridge 500 is in contact with the inclined surface of the thread 102 of the upper shaft facing the anti-slip step.

A lower portion of the cartridge 500 is accommodated in the ball shutter 600, and the ball-shutter movement protrusion 509 is located at the lower end (the direction of the cam 400) of the cartridge movement slit 609 of the ball shutter 600 (because a force for pushing the cartridge 500 and the ball shutter 600 relative to each other is generated by a restoring force of the first spring 71 disposed between the first spring locking step 503 of the cartridge 500 and an end of the holder 604 of the ball shutter 600).

Further, since the holder 604 is pulled from the O-ring 602 supported on the ring support step 204 by the restoring force of the second spring 72 located between the lower shaft 200 and the ball shutter 600, the spherical door 603 rotates, thus air-tightly closing the entrance of the holder 604.

The cam 400 is accommodated in the upper shaft 100. Hence, the upper-shaft coupling ring 403 of the cam 400 engages with the cam coupling groove 105 of the upper shaft 100, and the cam support step 106 engages with the anti-rotation slit 404, so that the cam 400 is fixedly coupled in the upper shaft 100.

Further, the eraser holder 300 is accommodated in the intermediate connection member 700, so that the slit movement protrusion 301 protrudes out of the slit 702.

At this time, the slit movement protrusion 301 is located above the thread movement protrusion 504 of the cartridge 500, and the threaded protrusion 405 of the cam 400 is disposed on the inclined surface of the lower end (the direction of the slit movement protrusion 301) of the thread 302 of the eraser holder 300.

Figure 11:
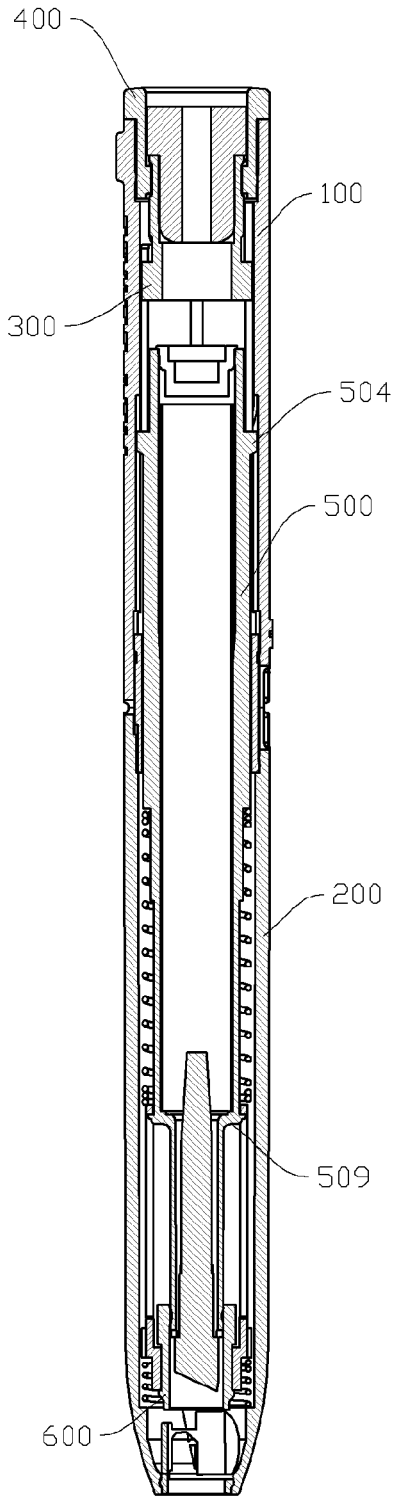
FIG. 11 is a view illustrating a state in which the writing implement with simultaneous retractable ends according to the embodiment of the present invention moves forwards.

In such a state, as shown in FIG. 11, if the lower shaft 200 fixedly coupled with the intermediate connection member 700 rotates (in a direction towards the inclined surface of the thread of the upper shaft 100), the thread movement protrusion 504 protruding out of the slit 702 of the intermediate connection member 700 moves downwards along the inclined surface of the upper-shaft thread 102, and moves linearly downwards on the slit, so that the cartridge 500 moves forwards towards the nib hole 205.

With the forward movement of the cartridge 500, the first spring 71 and the ball shutter 600 integrally move forwards (in this case, the first spring 71 is barely compressed). With the compression of the second spring 72 interposed between the ball shutter 600 and the lower shaft 200, a restoring force acts on the ball shutter 600 (the operating mechanism is described in detail in the opening module of the previous application), so that the spherical door 603 opens the holder 604 and provides a course along which the nib 501 moves.

Further, as soon as the intermediate connection member 700 rotates, the eraser holder 300 is also rotated by the slit movement protrusion 301 of the eraser holder 300 placed on the slit 702 of the intermediate connection member 700. As the eraser holder 300 rotates, the thread 302 engages with the threaded protrusion 405 of the cam 400 and thereby moves upwards.

In such a state, if the lower shaft 200 is further rotated, the thread movement protrusion 504 of the cartridge 500 continues moving downwards while coming into contact with the inclined surface of the upper-shaft thread 102, and moves downwards on the slit.

Until the writing implement reaches the locked state, the slit movement protrusion 301 of the eraser holder 300 rotates integrally with the intermediate connection member 700. Thereby, the thread engages with the threaded protrusion 405 of the cam 400, so that the eraser holder 300 continues moving upwards. Therefore, the eraser holder 300 moves linearly upwards on the slit.

Further, as the thread movement protrusion 504 of the cartridge 500 continues moving downwards in the state in which the ball shutter 600 is open by the compression of the second spring 72, the first spring 71 interposed between the first spring locking step 503 of the cartridge 500 and the end of the holder 604 of the ball shutter 600 is compressed, and the ball-shutter movement protrusion 509 of the cartridge 500 moves downwards (forwards) along the cartridge movement slit 609 of the ball shutter 600.

Figure 12:
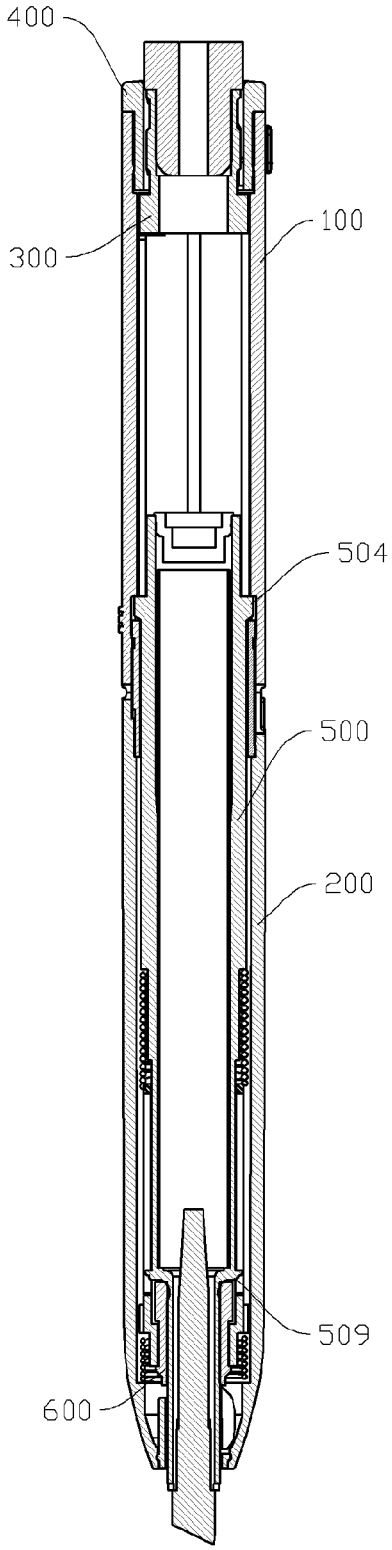
FIG. 12 is a view illustrating a state in which the writing implement with simultaneous retractable ends according to the embodiment of the present invention is locked.

As shown in FIG. 12, if the lower shaft 200 continues rotating, the anti-rotation protrusion 701 of the intermediate connection member 700 makes contact with the stopper 103 of the upper shaft 100. As the lower shaft 200 is continuously rotated, the anti-rotation protrusion 701 passes over the stopper 103, and thereafter is caught by the locking step 104, that is, located between the stopper 103 and the locking step 104, and maintains the locked state so that the intermediate connection member 700 does not move in the opposite direction.

When the writing implement reaches the locked state as such, the slit movement protrusion 301 of the eraser holder 300 moving linearly along the slit 702 is rotated and seated on the anti-slip step 703 formed on the slit 702.

If the locked state (the state in which the anti-rotation protrusion 701 is located between the stopper 103 and the locking step 104 so that rotary movement cannot be performed) is achieved, the nib 501 is in a locked position so that the nib 501 does not move backwards while protruding from the nib hole 205.

In such a locked state, when the lower shaft 200 is rotated by a force acting in the opposite direction so that the anti-rotation protrusion 701 of the intermediate connection member 700 passes over the stopper 103 of the upper shaft 100, the first spring 71 generates a restoring force, so that the first spring 71 pushes the cartridge 500 thereby moving the cartridge 500 backwards.

As the cartridge 500 moves backwards, the thread movement protrusion 504 rotates while moving upwards along the upper-shaft thread 102, and moves linearly upwards along the slit 702 of the intermediate connection member 700.

The rotation of the cartridge 500 also causes the intermediate connection member 700 to rotate, so that the slit movement protrusion 301 of the eraser holder 300 seated on the anti-slip step 703 of the intermediate connection member 700 is rotated towards the slit 702 again to be placed on a linear course of the slit 702.

Thereby, the cartridge 500 moves upwards while rotating along the thread, and moves linearly upwards along the slit.

Further, the eraser holder 300 moves downwards while being rotated by the thread engaging with the threaded protrusion 405 of the cam 400, and moves linearly downwards along the slit.

If the nib 501 is located in the holder 604 of the ball shutter 600 as the cartridge 500 is moved backwards by the restoring force of the first spring 71, the second spring 72 generates a restoring force, so that the ball shutter 600, the first spring 71 and the cartridge 500 are integrally moved backwards.

As a distance between the holder 604 and the O-ring 602 of the ball shutter 600 secured to the ring support step 204 of the lower shaft 200 is increased by the restoring force of the second spring 72, the spherical door 603 rotates to close the entrance of the holder 604.

The backwardly moved cartridge 500 continues rotating upwards until its thread movement protrusion 504 comes into contact with the end of the upper-shaft thread 102 and does not move any more. If the thread movement protrusion 504 comes into contact with the end of the upper-shaft thread 102, all of the cartridge 500, the intermediate connection member 700 and the lower shaft 200 stop rotating.

In the above state, the first spring 71 generates a force to push the ball shutter 600 and the cartridge 500 relative to each other, so that the thread movement protrusion 504 comes into close contact with the end of the thread. Thereby, the writing implement returns to the state of FIG. 10.

The invention claimed is:

1. A writing implement with simultaneous retractable ends, comprising:

a cartridge having a writing nib;

an intermediate connection member having a slit to move the cartridge up and down while accommodating the cartridge therein;

a lower shaft fixedly coupled with the intermediate connection member, and having a nib hole through which the nib is ejected or retracted;

an upper shaft having a thread to move the cartridge accommodated in the intermediate connection member, as the intermediate connection member and the lower shaft rotate integrally;

a cam fixedly coupled to an end of the upper shaft, with a protrusion formed on an inner wall of the cam;

an eraser holder accommodated in the intermediate connection member to rotate up and down while engaging with an inner protrusion of the cam and a slit of the intermediate connection member, as the intermediate connection member and the lower shaft rotate integrally; and a ball shutter accommodated in the lower shaft so that vertical movement of the cartridge will open and close the nib hole.

2. The writing implement according to claim 1, wherein the cartridge comprises:

a ball-shutter locking step formed on a junction between a nib extension shaft and an ink supply part, thus preventing the nib of the cartridge passing through an interior of the ball shutter from moving forwards any more from the ball shutter;

a first spring locking step protruding from a predetermined position on an outer surface of the ink supply part so that a first spring generates an elastic force between the cartridge and an upper end of the ball shutter;

a thread movement protrusion protruding from an end of the ink supply part, and moving along the thread of the upper shaft while simultaneously moving linearly along the slit of the intermediate connection member; and a ball-shutter movement protrusion protruding from the ball-shutter locking step in such a way as to move linearly within a slit of the ball shutter.

3. The writing implement according to claim 2, wherein a holder of the ball shutter has a cartridge movement slit in a direction of the cartridge, so that the ball-shutter movement protrusion of the cartridge moves within the cartridge movement slit.

4. The writing implement according to claim 1, wherein the intermediate connection member comprises:

a lower-shaft coupling ring provided on a lower end thereof in a shape of a convex ring so that a lower portion thereof fixedly engages with a corresponding inner groove of the lower shaft;

an annular upper-shaft coupling groove formed at a position spaced apart from the lower-shaft coupling ring by a predetermined distance, thus allowing the intermediate connection member and the upper shaft to be rotatably coupled with each other;

an anti-rotation protrusion protruding at a position spaced apart from the upper-shaft coupling groove by a predetermined distance; and an anti-slip step formed on an upper end of a slit extending from the anti-rotation protrusion to an upper end of the intermediate connection member, wherein a thread movement protrusion of the cartridge accommodated in the intermediate connection member protrudes out of the slit, so that the thread movement protrusion moves within the slit by rotation of the intermediate connection member and the lower shaft, and the eraser holder moves in a space of the slit located at the upper end of the intermediate connection member, so that the eraser holder moving towards the upper end along the slit stops moving towards the nib because of the anti-slip step.

5. The writing implement according to claim 4, wherein the intermediate connection member further comprises a lower-shaft coupling slit on the lower-shaft coupling ring to be perpendicular to the lower-shaft coupling ring so that the intermediate connection member is firmly coupled with the lower shaft, the lower-shaft coupling slit engaging with a step formed at a corresponding position on the lower shaft when the intermediate connection member is coupled with the lower shaft.

6. The writing implement according to claim 1, wherein the lower shaft comprises:

a groove formed at a position corresponding to a lower-shaft coupling ring of the intermediate connection member to engage with the lower-shaft coupling ring, thus allowing the lower shaft to be fixedly coupled with the intermediate connection member;

a ring support step formed on an inner wall of a predetermined portion of the lower shaft to allow an upper ring of the ball shutter to be fixedly attached; and a second spring locking step formed at a position spaced apart from the ring support step by a predetermined distance so that the second spring locking step and a step formed on an outer surface of the ball shutter come into contact with opposite ends of the second spring.

7. The writing implement according to claim 1, wherein the upper shaft comprises:

an intermediate-connection-member coupling ring formed on a lower portion of an inner surface thereof to be rotatably coupled with an upper-shaft coupling groove of the inserted intermediate connection member;

a stopper formed at a position spaced apart from the intermediate-connection-member coupling ring by a predetermined distance, and having a predetermined protruding thickness to allow an anti-rotation protrusion of the intermediate connection member to pass over the stopper;

a locking step provided at a position around the stopper, and having a predetermined protruding thickness to prevent the anti-rotation protrusion of the intermediate connection member from passing over the locking step;

an upper-shaft thread formed at a position spaced apart from the stopper or the locking step by a predetermined distance to form a guide line along which a thread movement protrusion of the cartridge moves while the cartridge rotates together with the intermediate connection member;

a cam coupling groove formed in an upper portion of the upper shaft in a ring shape to engage with a coupling ring of the cam; and a cam support step formed on the cam coupling groove in such a way as to be perpendicular thereto, thus allowing the cam to be fixedly coupled to the upper shaft.

8. The writing implement according to claim 1, wherein the cam comprises:

a threaded protrusion formed in the cam to move upwards along a thread of the eraser holder;

an upper-shaft coupling ring protruding from a lower portion on an outer surface of the cam in a ring shape to be fixedly coupled with the upper shaft; and an anti-rotation slit formed on the upper-shaft coupling ring in such a way as to be perpendicular thereto, thus preventing the cam from rotating.

9. The writing implement according to claim 1, wherein the eraser holder comprises:

a slit movement protrusion formed on an outer surface of a lower end of the eraser holder to move linearly while protruding out of a slit of the intermediate connection member;

a thread formed on an outer surface of the eraser holder from the slit movement protrusion to an upper end of the eraser holder, thus allowing a threaded protrusion of the cam to move up and down along the thread; and an eraser receiving portion formed in an upper end of the eraser holder to receive an eraser therein.

* * * * *